US006710254B2

(12) United States Patent
Yueh

(10) Patent No.: US 6,710,254 B2
(45) Date of Patent: Mar. 23, 2004

(54) CABLE HAVING LOCATION-INDICATING FUNCTION

(75) Inventor: Ching Yueh, Taipei (TW)

(73) Assignee: Test Rite International Company, Ltd., Taipei (TW)

( * ) Notice: Subject to any disclaimer, the term of this patent is extended or adjusted under 35 U.S.C. 154(b) by 0 days.

(21) Appl. No.: 10/302,563

(22) Filed: Nov. 25, 2002

(65) Prior Publication Data

US 2004/0020684 A1 Feb. 5, 2004

(30) Foreign Application Priority Data

Aug. 5, 2002 (CN) ..... 02 2 42748 U

(51) Int. Cl.[7] ..... H01B 7/00

(52) U.S. Cl. ..... 174/135; 174/53; 439/490; 439/502

(58) Field of Search ..... 174/135, 53; 439/490, 439/502, 910; 340/656, 687

(56) References Cited

U.S. PATENT DOCUMENTS

| | | | | | |
|---|---|---|---|---|---|
| 4,101,190 | A | * | 7/1978 | Schoff | 439/281 |
| 5,207,594 | A | * | 5/1993 | Olson | 439/490 |
| 5,780,775 | A | * | 7/1998 | Yu | 174/135 |
| 5,929,386 | A | * | 7/1999 | Hornick | 174/135 |
| 6,337,444 | B1 | * | 1/2002 | Liao | 174/135 |
| 6,349,452 | B1 | * | 2/2002 | Cisneros | 439/502 X |

* cited by examiner

*Primary Examiner*—Dhiru R Patel
(74) *Attorney, Agent, or Firm*—Bacon & Thomas, PLLC

(57) ABSTRACT

The present invention relates to a cable having location-indicating function, having a socket, a plug and a cable body for connecting the foregoing two, at least one illuminating device is disposed in parallel on the cable body, with the cable body providing the luminous body in the illuminating device with electricity needed for illuminating, so as to indicate passers-by with the location of the cable, thus achieving the location-indicating function.

1 Claim, 4 Drawing Sheets

CABLE HAVING LOCATION-INDICATING FUNCTION

BACKGROUND OF THE INVENTION

1. Field of the Invention

The present invention relates to a cable, more particularly, a cable having location-indicating function, at least one illuminating device is disposed on such cable body, whereby the location of the cable is explicitly indicated for passers-by, thus achieving the location-indicating function.

2. Description of Related Arts

Please refer to FIG. 1, wherein the conventional extension cable is shown. The object of such extension cable is to extend further the stationary power, thus a plug 11 and a socket 12 are respectively disposed on both ends of such conventional extension cable, so as to transmit electricity through the connection of the cable body 13. However, the use of extension cables is not supposed to be permanent, sometimes it is only temporary; therefore, with the period of use being short, passers-by shall not be able to notice the existence of such extension cable. Furthermore, since the installation of extension cables is usually temporary, the location installed, not being stationary, is up to the convenience of users, with the location possibly being at hallways, on walls or suspending downwards from ceilings.

There is no apparent indication signs attached on the conventional extension cables, thus passers-by not knowing the location of such extension cables are apt to be tripped thereby, and such extension cables may subsequently be pulled and detached from the power connected therewith, thus causing short circuitry and therefore injuries to people, especially as such extension cables are installed at locations without enough illumination, such as construction sites, the foregoing situations are to occur frequently, causing users unable to prevent such dangerous episodes from recurring.

SUMMARY OF THE INVENTION

In view of the fact that there is no apparent indication signs attached on the conventional extension cables, so that danger may occur at locations without enough illumination or at night, the present invention then provides with a cable having location-indicating function, at least one illuminating device is disposed on the cable body, so as to explicitly indicate the location of the cable for passers-by.

For achieving the foregoing object, the present invention then provides with a cable having location-indicating function, comprising a plug, a socket and a cable body for connecting the foregoing two, an illuminating device is disposed on the cable body, including a luminous body disposed at the interior thereof as an illumination source and a transparent protection body covered at the exterior thereof.

At least one illuminating device is disposed on the cable.

Both ends of the transparent protection body of the illuminating device are disposed with stress elimination device.

The luminous body within the illuminating device is an LED or a neon lamp.

The luminous body within the illuminating device is disposed in parallel with the transmission circuit of the internal power.

The luminous body within the illuminating device receives power needed from the transmission circuit of the internal power in the cable body.

BRIEF DESCRIPTION OF THE DRAWINGS

These and other features, aspects and advantages of the present invention will become better understood with regard to the following description, appended claims and accompanying drawings that are provided only for further elaboration without limiting or restricting the present invention, where:

DETAILED DESCRIPTION OF THE PREFERRED EMBODIMENT

The following is a detailed description of the best presently known modes of carrying out the inventions. This description is not to be taken in a limiting sense, but is made merely for the purpose of illustrating the general principles of the inventions.

Figure 1:
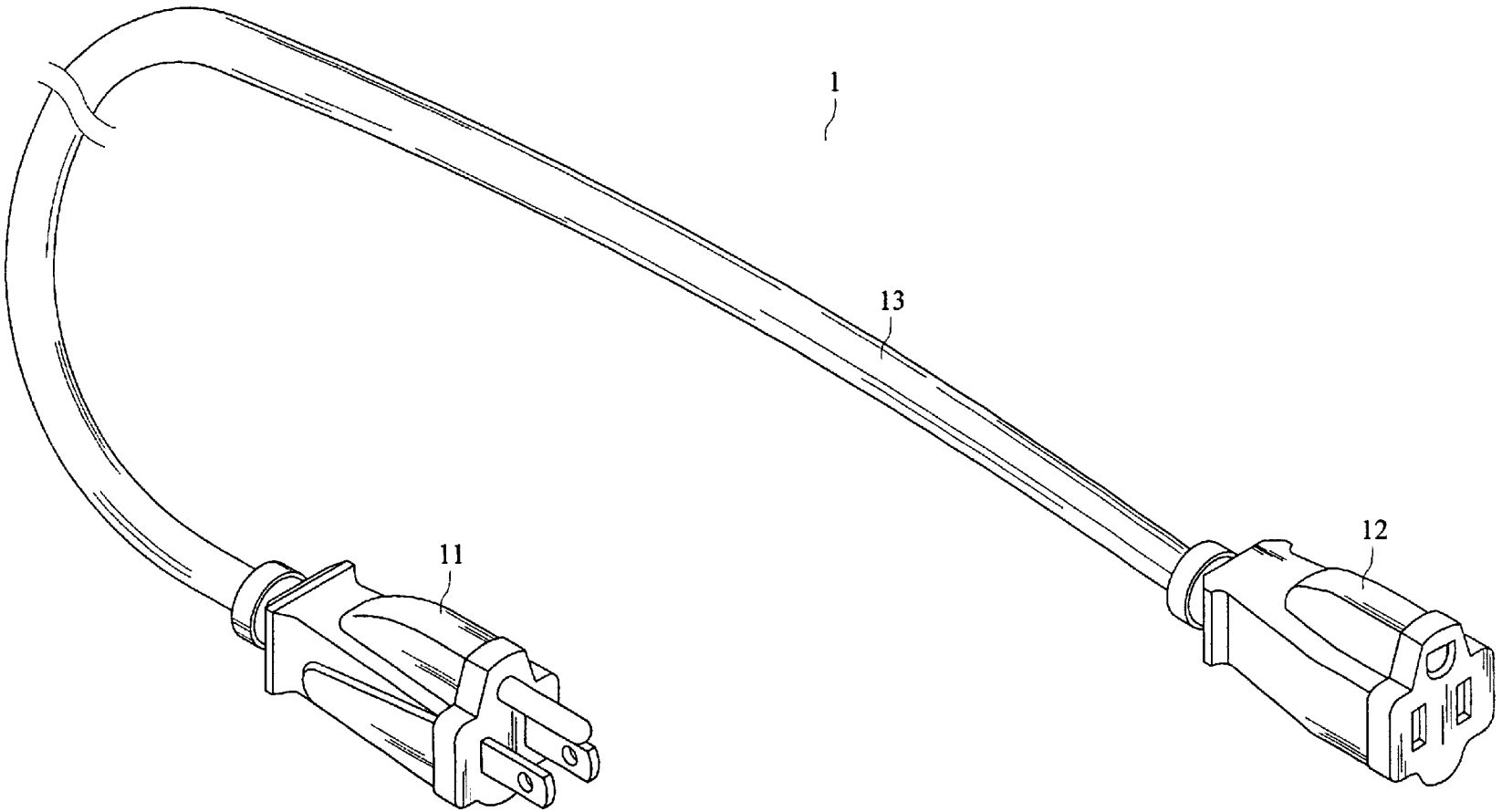
FIG. 1 shows a conventional extension cable.
Figure 2:
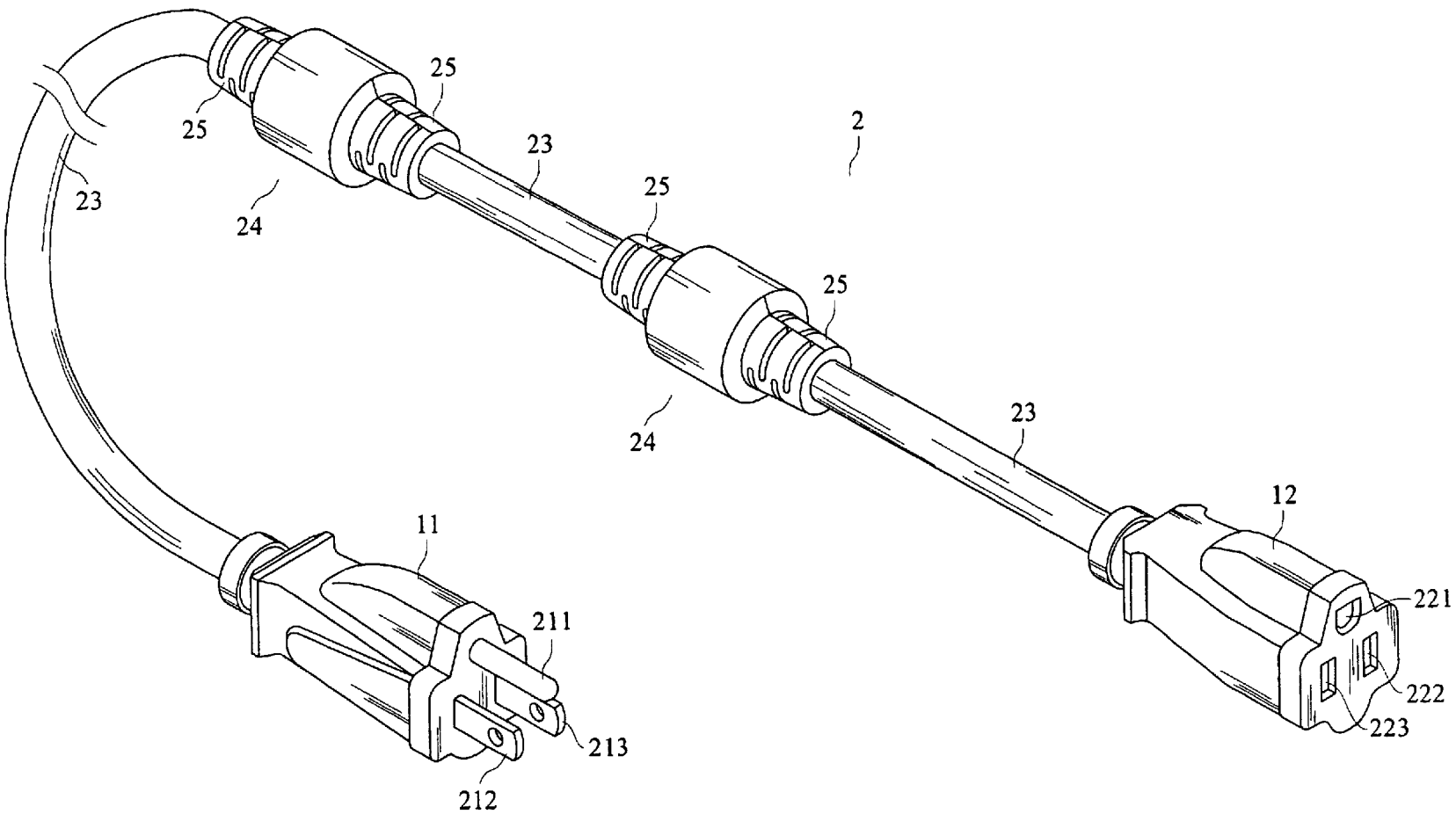
FIG. 2 shows a structural view of the cable having location-indicating function of the present invention.

Please refer to FIG. 2, wherein the cable 2 having location-indicating function of the present invention is shown. The cable 2 comprises a cable body 23, a plug 11, a socket 12, a plurality of illuminating device 24 and a plurality of stress elimination device 25. The plug 11 and the socket 12 are respectively disposed at both ends of the cable body 23, which connects in tandem with a plurality of illuminating device 24, with both ends of the illuminating device 24 being respectively disposed with a stress elimination device 25.

Figure 3:
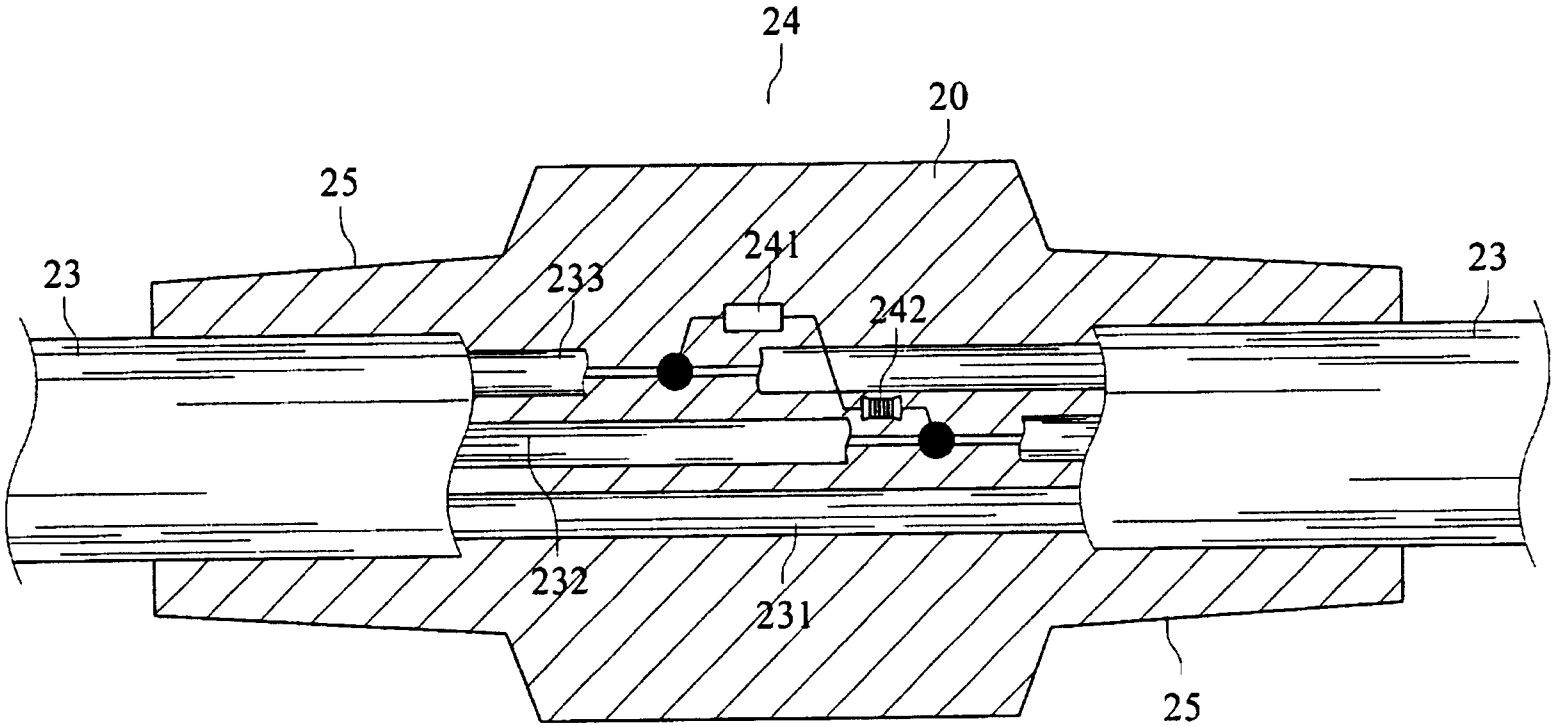
FIG. 3 shows a sectional view of the illuminating device of the cable having location-indicating function of the present invention.

Please refer to FIG. 2 and FIG. 3, wherein the cable body 23 can be for example a three-strand copper wire including a live wire 232, an earth wire 233 and an earth connection wire for equipment 231, corresponded by a live wire end 212, an earth wire end 213 and an earth connection end for equipment 211 of the plug 11, and a live wire socket 222, an earth wire socket 223 and an earth connection socket for equipment 221 of the socket 12. As the plug 11 engages with a stationary power, electricity is transmitted to the cable body 23, so as to provide the illuminating device 24 with electricity needed. The socket 12 is utilized for a plurality of cables 2 to be connected in tandem, thus extending the length of the cable 2.

As shown in FIG. 3, a protection layer 20 made of a transparent material (e.g., PVC) is applied on the outer layer of the illuminating device 24, with the protection layer 20 having the luminous body, such as neon lamp 241, and the resistor 242 disposed therein, and such resistor 242 is soldered between the live wire 232 and the earth wire 233 in tandem. Through the protection layer 20 protecting the neon lamp 241, the resistor 242 and the junctures thereof, the object of both preventing moisture from infiltrating therein thus causing short circuitry and enabling the cable to sustain tramples from passers-by can thus be achieved. During usage and storage, the cable 2 may often be contorted, therefore the stress elimination device 25 extended further from both ends of the protection layer 20 are disposed so as to prevent the illuminating device 24 from being ruptured because of any contortion of the cable body 23.

Since the neon lamp 241 may provide with illumination by utilizing the power of alternating current, no extra power conversion apparatus shall be needed, thus enabling convenient usage and lowering of cost for cables. At the same time, the illuminating device 24 are disposed on the live wire 232 and the earth wire 233 of the cable body 23 in parallel, thus preventing any dysfunctional individual illuminating device from adversely affecting the illuminating function of other illuminating device.

Figure 4:
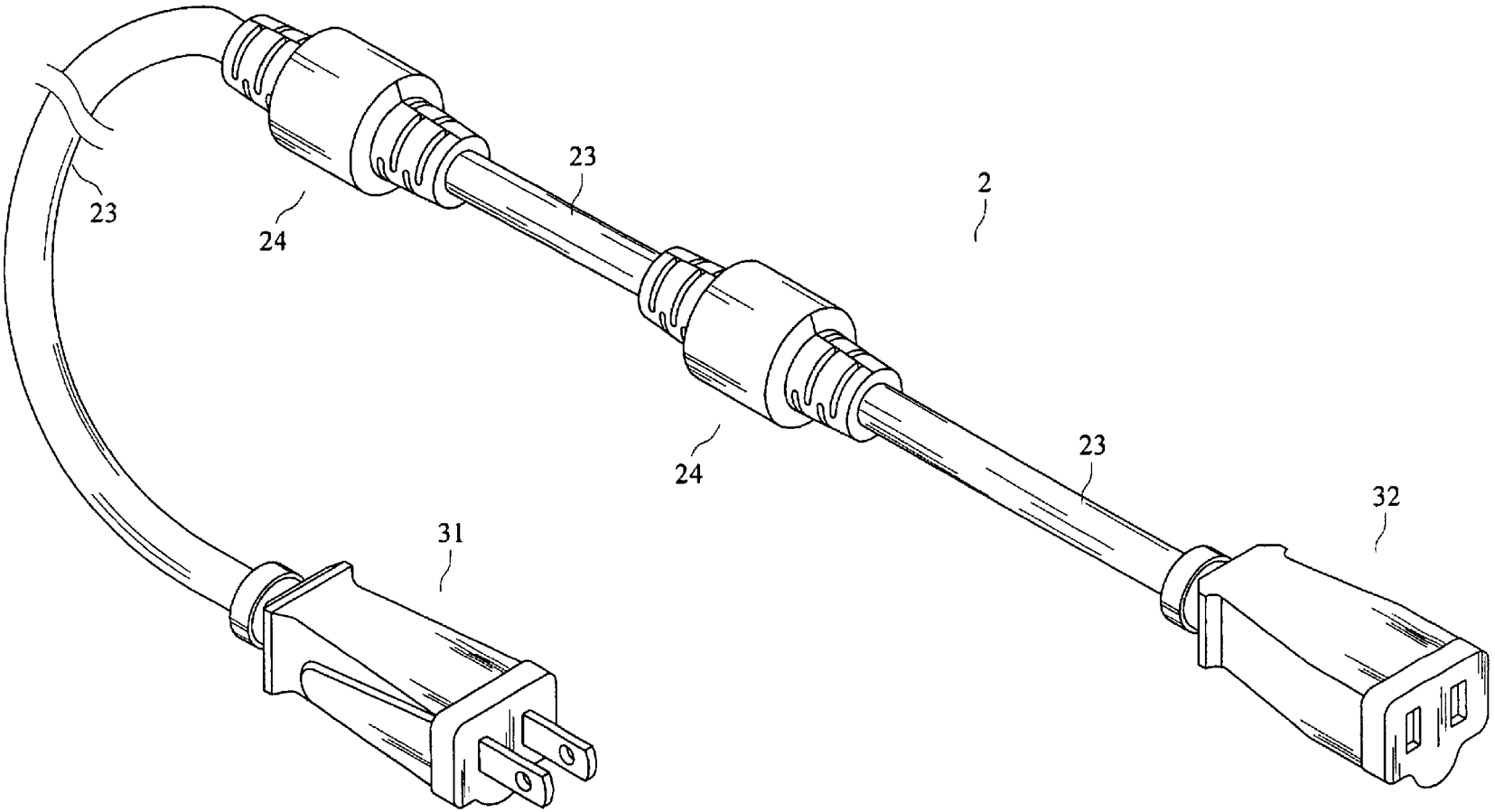
FIG. 4 shows another embodiment of the cable having location-indicating function of the present invention.

Please refer to FIG. 4, wherein another embodiment of the cable having location-indicating function of the present invention is shown. Since the specifications for plugs and sockets in countries all over the world might not be identical, the plug 11 and the socket 12 of the cable 2 can be converted according to various specifications. For example, FIG. 4 shows that the plug 31 is a two-pole plug and the socket 32 is a two-hole socket., with other features identical to those shown in FIG. 3.

Although the present invention has been described in considerable detail with reference to certain preferred embodiments thereof, those skilled in the art can easily understand that all kinds of alterations and changes can be made within the spirit and scope of the appended claims. Therefore, the spirit and scope of the appended claims should not be limited to the description of the preferred embodiments contained herein.

What is claimed is:

1. A cable having location-indicating function, comprising:

a cable body, a plug disposed at one end of said cable body, a socket disposed at the other end of said cable body and at least one illuminating device disposed between said plug and said socket of said cable body, said illuminating device having a luminous body therein being covered with a protection layer which enabling light to go through, wherein both ends of said protection layer of said illuminating device are disposed with stress elimination device and said luminous body connected in parallel to the transmission circuit of the internal power in said cable.

* * * * *